US006695302B1

(12) United States Patent
Lamothe

(10) Patent No.: US 6,695,302 B1
(45) Date of Patent: Feb. 24, 2004

(54) METHOD AND APPARATUS FOR SEPARATING A STREAM OF SPACED DOCUMENTS INTO DISCRETE GROUPS

(75) Inventor: Richard P. Lamothe, Burlington, CT (US)

(73) Assignee: Energy Saving Products and Sales Corporation, Burlington, CT (US)

( * ) Notice: Subject to any disclaimer, the term of this patent is extended or adjusted under 35 U.S.C. 154(b) by 295 days.

(21) Appl. No.: 09/764,934

(22) Filed: Jan. 18, 2001

Related U.S. Application Data

(63) Continuation-in-part of application No. 09/699,860, filed on Oct. 30, 2000, now abandoned, which is a continuation of application No. 09/630,830, filed on Aug. 2, 2000, now abandoned.

(60) Provisional application No. 60/162,336, filed on Oct. 29, 1999.

(51) Int. Cl.[7] ..... B65H 29/50

(52) U.S. Cl. ..... 271/9.12; 271/218; 271/214; 271/217; 414/791.2; 414/790

(58) Field of Search ..... 414/791.2, 789.9, 414/790, 790.1; 271/218, 207, 213, 214, 217, 9.12

(56) References Cited

U.S. PATENT DOCUMENTS 3,860,127 A * 1/1975 Fassman ..... 414/791.2
3,997,154 A * 12/1976 Mol ..... 271/215
4,091,978 A * 5/1978 Graham, II ..... 225/100
4,394,687 A * 7/1983 Hutt et al. ..... 348/467
4,478,403 A * 10/1984 Byrt ..... 271/189
4,508,333 A * 4/1985 Byrt ..... 271/218
4,905,979 A * 3/1990 Limbach et al. ..... 271/176
5,007,625 A 4/1991 Kremers et al.
5,540,370 A * 7/1996 Ring ..... 225/100
5,613,673 A 3/1997 Roberts et al.
5,704,604 A 1/1998 Koelle et al.
6,227,531 B1 5/2001 Guerrero et al.
6,485,010 B1 * 11/2002 Lamothe ..... 270/52.09

* cited by examiner

*Primary Examiner*—Patrick Mackey
(74) *Attorney, Agent, or Firm*—McCormick, Paulding & Huber LLP

(57) ABSTRACT

Documents are fed in a stream through the first station of a machine that senses the last page of each document along alternative paths in order to accumulate the groups in a staggered stack on a vertically adjustable elevator. When this staggered stack reaches a predetermined number (N) the elevator drops down to off load the stack onto a takeaway conveyor. The documents continue to be accumulated at the second station on a reciprocating support surface that redeposits these additional documents on the elevator when the elevator returns to a raised position and the support surface is retracted.

17 Claims, 10 Drawing Sheets

METHOD AND APPARATUS FOR SEPARATING A STREAM OF SPACED DOCUMENTS INTO DISCRETE GROUPS

CROSS REFERENCE TO RELATED APPLICATIONS

This application is a continuation-in-part of an application of the same title filed Oct. 30, 2000 and identified by Ser. No. 09/699,860, now abandoned which application was itself a continuation of Ser. No. 09/630,830, now abandoned, filed on Aug. 2, 2000. The latter application claimed priority to a prior provisional case Ser. No. 60/162,336 filed Oct. 29, 1999. All the above-identified applications are incorporated by reference herein as is a commonly assigned application entitled Page Length Marking System for Continuous Paper Web filed Mar. 15, 2000 under Ser. No. 09/525,554, now abandoned.

FIELD OF THE INVENTION

This invention relates generally to forming discrete groups of documents into convenient bundles or books from at least one, and preferably two, side-by-side streams of documents.

A conventional laser printer or other device capable of printing continuously on a web of paper fed through the printer provides printed indicia in spaced relationship on the web, and in side by side-by-side columns, so as to allow the printed web to be slit, and then cut laterally to form successive printed pages. The present invention relates to collating the pages into books, or groups of pages, from the side-by-side web segments so as to make up printed collated pages representing individual books or jobs.

The slitting and cutting of the printed web can be carried out in a conventional cutter of the type sold by the assignee of the present invention, or by others, such as the Bowe Cutter which is manufactured in Europe and is widely sold through out the United States. Such a cutter slits the continuous paper web and provides side-by-side web segments that are in turn cut laterally by a rotary cutter to provide streams of side-by-side documents to an apparatus of the present invention.

SUMMARY OF THE INVENTION

This invention relates to a method and apparatus for grouping documents fed downstream, as from a slitter/cutter, in at least one stream of end-to-end documents, and preferably in side-by-side streams of documents, which documents are accumulated in predetermined numbers on a vertically movable elevator/table. Every other group of documents to be separated is shifted laterally so that successive stacks of documents are provided one on top of the other in offset relationship to one another on the elevator/table. The elevator/table is gradually lowered to accommodate a plurality of such alternately offset first and second document groups. After the elevator has accumulated many such groups, the entire bundle is moved off the elevator/table onto a takeway conveyor. A temporary support surface is provided for the documents fed to the elevator when the elevator is being off loaded, and these documents are then transferred from the temporary support surface onto the elevator once the elevator has been unloaded and returned into position for receiving additional documents.

In further accordance with the present invention, the temporary support surface comprises projecting pins that normally reside below the path of movement of the documents prior to movement into a position over the elevator/table. Thus, these pins are shifted in the downstream direction as required to accumulate documents or document groups while the elevator is being off loaded. The elevator is provided with conveyor belts for moving the pile of accumulated document groups from the elevator onto the takeaway conveyor for further processing. Thus, the documents will be stacked so that each group is offset laterally from an adjacent group in the pile in order to facilitate further handling, as for example arranging each of the individual groups or stacks into a corresponding booklet or job.

In its preferred form the mechanism for accomplishing the lateral offset of the documents prior to the elevator/table comprises a plurality of belt conveyors driven in the downstream direction. A slightly angled, relatively wider belt operates in conjunction with weighted spherical rollers provided in a fixed frame over the path of movement of the documents to impart a lateral shifting force on certain of the documents moving downstream. This lateral shifting of every other group or stack of documents is achieved by providing a gate for the documents that directs each of the documents either along a primary path where the documents travel straight downstream, or along a path such that the documents are influenced by the above-described weighted rollers and associated underlying conveyor for achieving the lateral motion required to shift every other group or stack of documents laterally.

Finally, duplicating the above-described structure will allow side-by-side streams of documents to be shifted laterally and collated, the one shifting conveyor system being a mirror image of the other. It will be apparent that the present invention requires some sort of optically readable mark on the first or last page of each job book or group to signal that the next page is another job, book or group. Such a marking system is described in the co-pending case, Ser. No. 09/525,554 filed Mar. 15, 2000 in a application entitled Page Length Marking System for Continuous Paper Web.

In order to provide alternate paths for the documents fed into the mechanism described above, a diverting section is provided at the upstream end of the apparatus of the present invention in order to direct the documents into one or the other of two laterally displaced paths, the one preferably comprising a straight path through the device whereas the other path provides for the lateral shifting of the documents by the mechanism of the present invention.

DETAILED DESCRIPTION OF THE DRAWINGS

Figure 1:
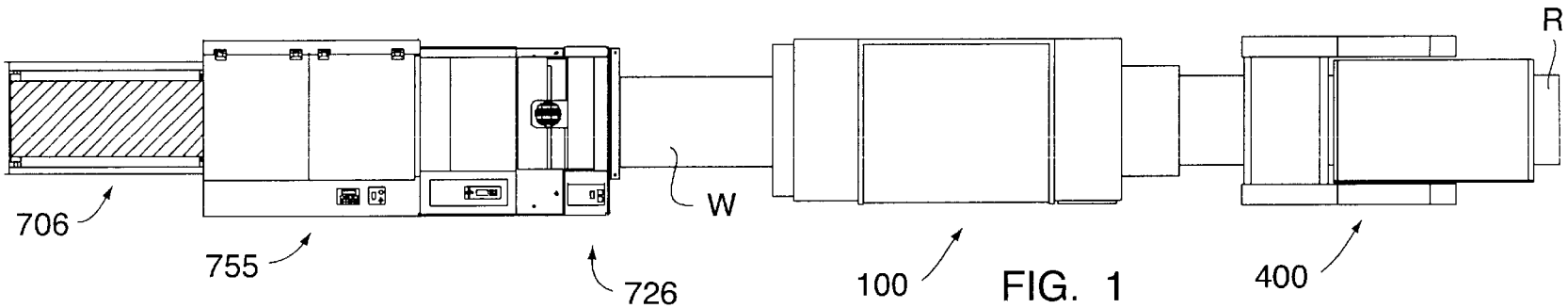
FIG. 1 is a top plan view of apparatus capable of carrying out the method of the present invention in a printing line which includes an unwinder, a laser printer, a slitter/cutter, and a cabinet associated with the cutter cabinet, containing the elements of the present invention, together with a takeaway conveyor at the downstream end thereof.

Turning now the drawings in greater detail, FIG. 1 shows a printing line with an unwind machine (400) supporting a roll (R) of paper to be printed in a manner suitable for feeding an intermittently operated laser printer (100). The printer includes suitable means for drawing the paper from the roll through a tension-free loop 14*a* that is controlled in depth so as to maintain the speed of the roll (R) to the speed at which the laser printer is operating. At the output end of the laser printer a second tension-free loop 14*b* is provided with the result that the cutter in cabinet (726) can operate in timed relationship with the laser printer to cut the paperweb in timed relationship with, and as a result of input signals from a control system that has, as an input, markings on the paperweb to indicate page length. The cutter cabinet (726) may also comprise a slitter that is adapted to slit the paperweb (W) in order to provide two side-by-side streams of documents that enter a cabinet (755) housing the components of the present invention. This cabinet (755) includes means for offsetting alternate groups of documents into books or jobs, accumulating these documents in a stack or pile, and then automatically unloading the pile onto a takeaway conveyor (706).

Figure 3:
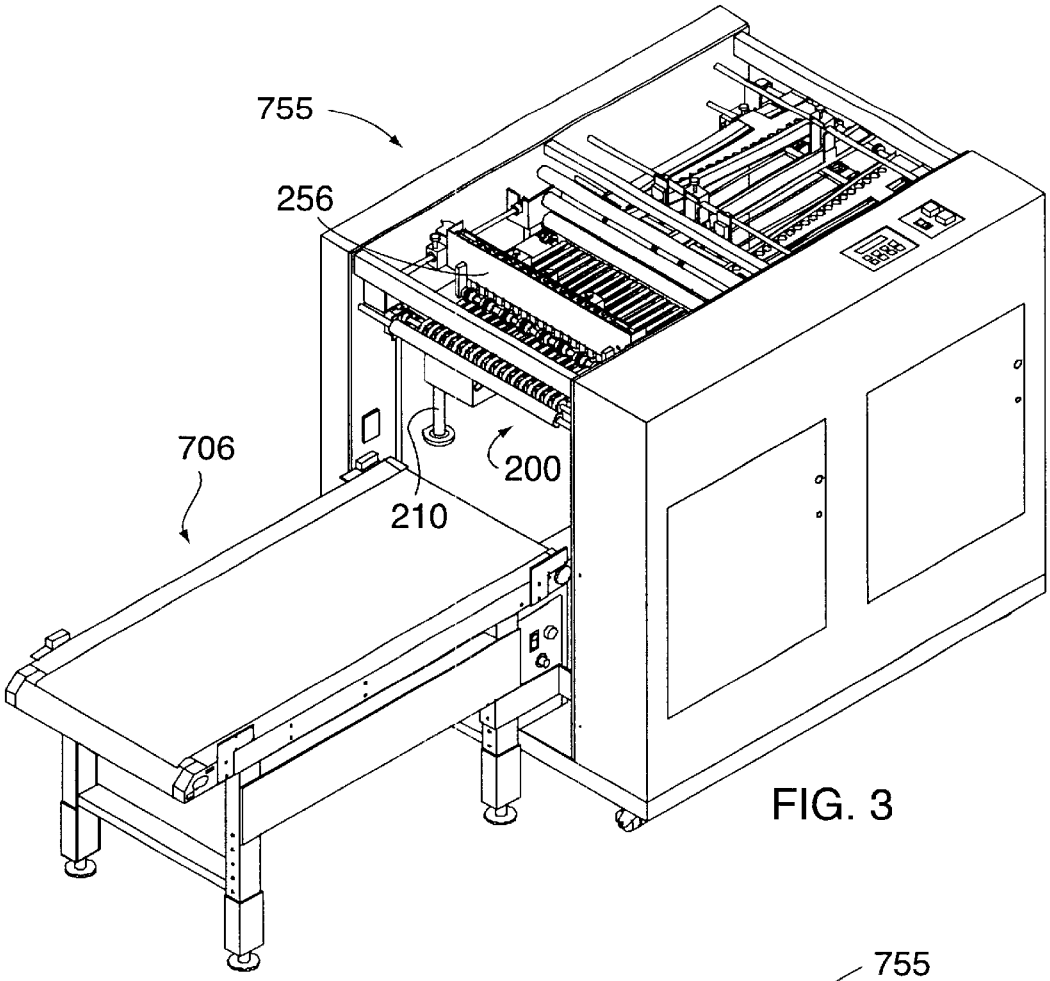
FIG. 3 is a perspective view illustrating the exit end of the cabinet containing components of the present invention together with the takeaway conveyor.
Figure 4:
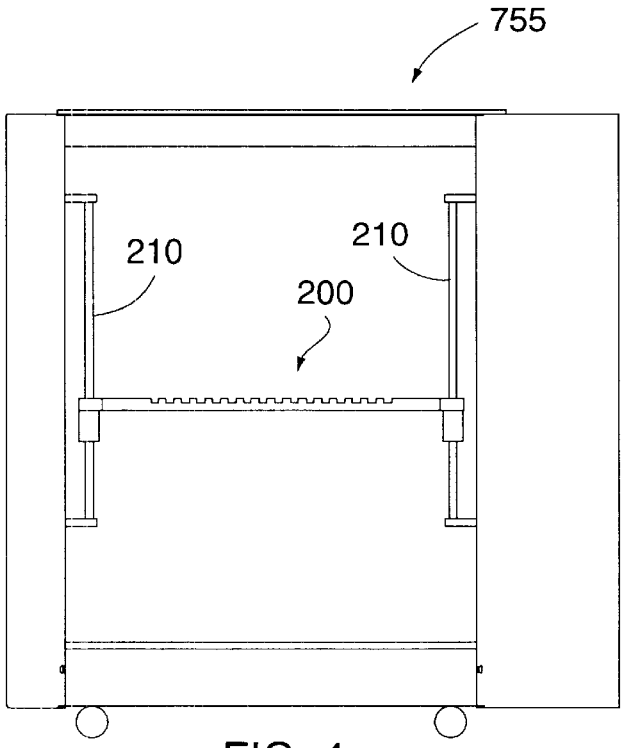
FIG. 4 is an end view of the cabinet of FIG. 3.

FIG. 4 shows the cabinet (755) from the downstream end. A vertically movable elevator/table (200) moves from the raised or up position shown for it in FIG. 3 through the intermediate position shown in FIG. 4 to a lowered position where the elevator table (200) is aligned with the bed of a takeaway conveyor (706). The top of the cabinet (755) is shown to better advantage in FIG. 5 where the elevator table can be seen to comprise a plurality of side-by-side belts (200*a*) that are selectively driven in the downstream direction by a signal from the control system to move the documents off the elevator/table. An adjustable stop (256) is positioned over the table to stack the documents on the elevator table (200) until a predetermined number have been accumulated for off loading again by the operation of these belts that make up the top of the elevator/table.

The elevator table is provided on jack screws (210) that operate in response to the height of the paper on the table to maintain the table at an appropriate height as the documents move downstream onto the table from upstream station, where the documents are alternatively offset in groups, and in a manner to be described.

Figure 6:
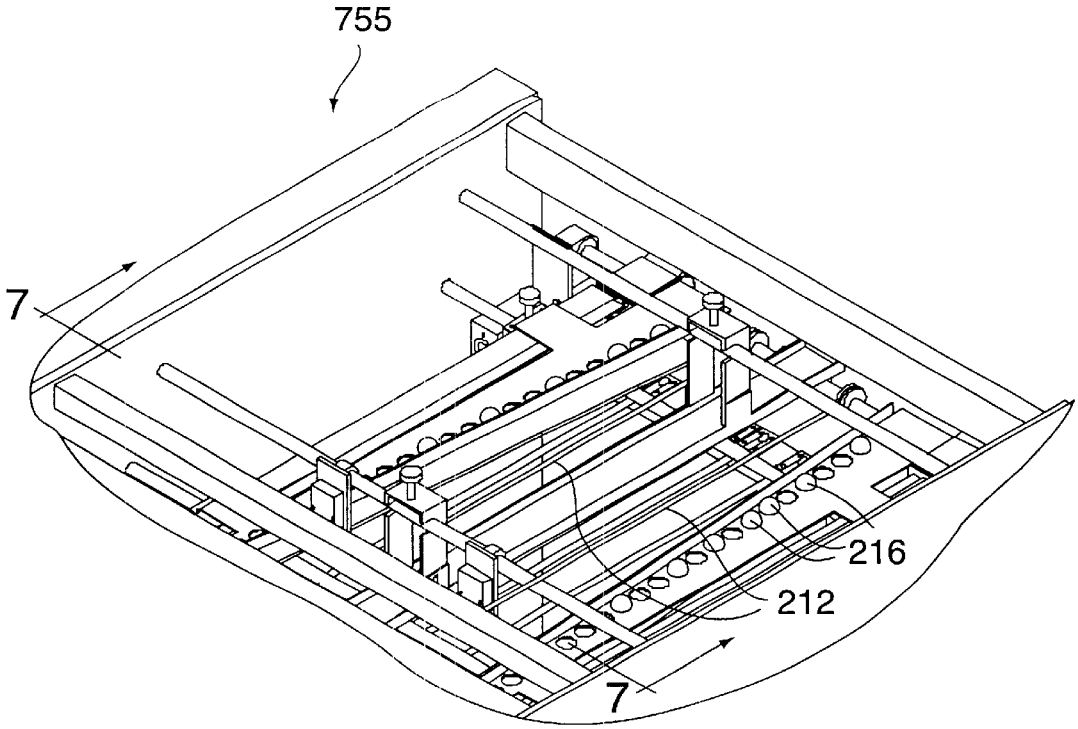
FIG. 6 is a photograph of the right hand or upstream portion of the apparatus in FIG. 5.
Figure 7:
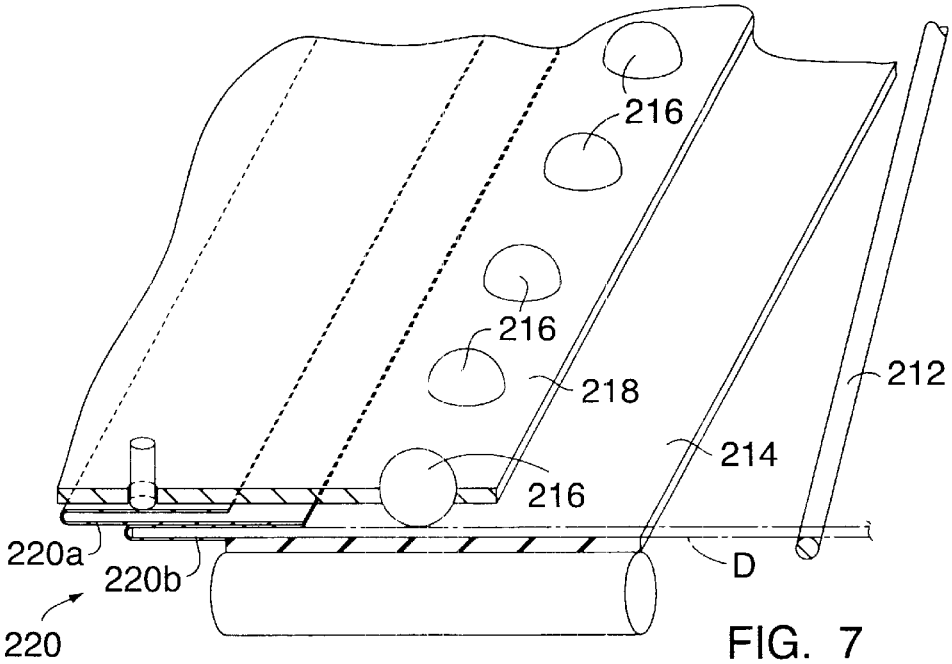
FIG. 7 is a sectional view taken generally on the line 7—7 of FIG. 6.

As best shown in FIG. 6, the documents enter the upstream station of the cabinet (755) from the right, to be fed by a plurality of round belts (212) that are driven in the downstream direction so as to impart a continuing force on the documents to move them downstream toward the elevator/table. With reference to FIGS. 6 and 7, a mechanism is provided on one or both sides of the center line of the cabinet to offset every other group of documents laterally. Preferably and as shown, said mechanism includes a relatively wide urethane belt (214) which is oriented at a slight angle relative to the downstream direction as best shown FIG. 7. The belt cooperates with weighted spherical rollers (216) held in a fixed frame or cage (218) that act upon the document illustrated in phantom lines at (D) in FIG. 7 to impart a lateral force on the documents, to be offset in order to alter the path of movement of each document as it moves downstream under the force of the belts (212) and the angled urethane belt (214).

Figure 8:
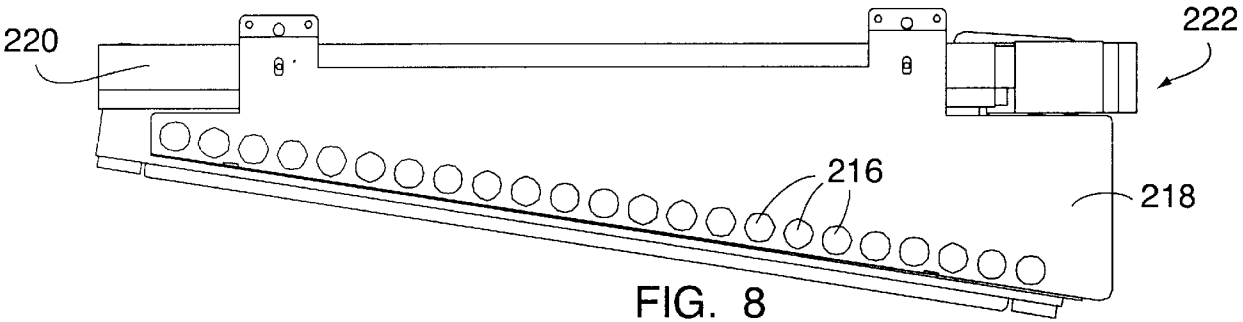
FIG. 8 is a top plan view of the mechanism for shifting certain of the documents laterally as they move downstream through the upstream station of FIG. 7 and FIG. 6.
Figure 9:
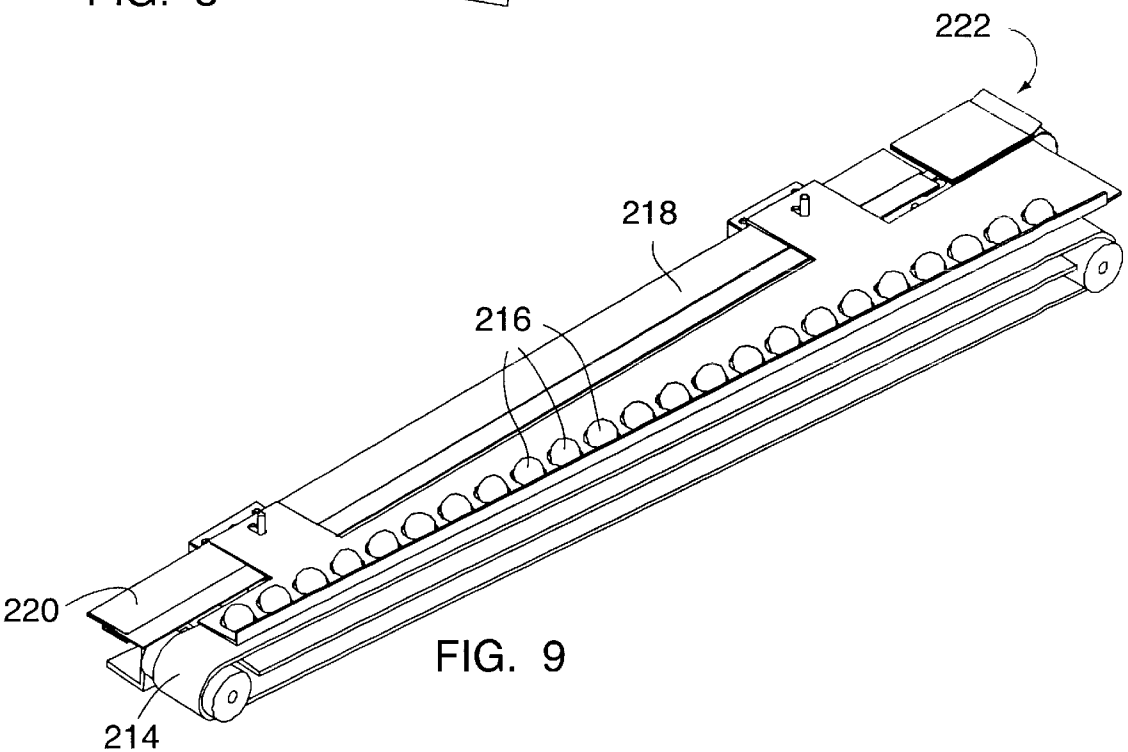
FIG. 9 is a prospective view of the mechanism of FIG. 8

FIGS. 7, 8 and 9 show a fixed side guide (220) associated with the urethane belt (214) and rollers (216). This side guide is shown in cross-section in FIG. 7 as defining at least one, and preferably two, tracks for the document (D) depending upon the path of the document as it moves through the mechanism of FIGS. 6, 7 and 9.

It will be seen that the fixed guide (220) is oriented parallel the normal downstream direction defined by the belts (212), and this guide has an upstream end (222) defining a split funnel that feeds the paper documents (D) into one or the other of the two channels (220*a* and 220*b*) as best shown in FIG. 7.

Figure 10A:
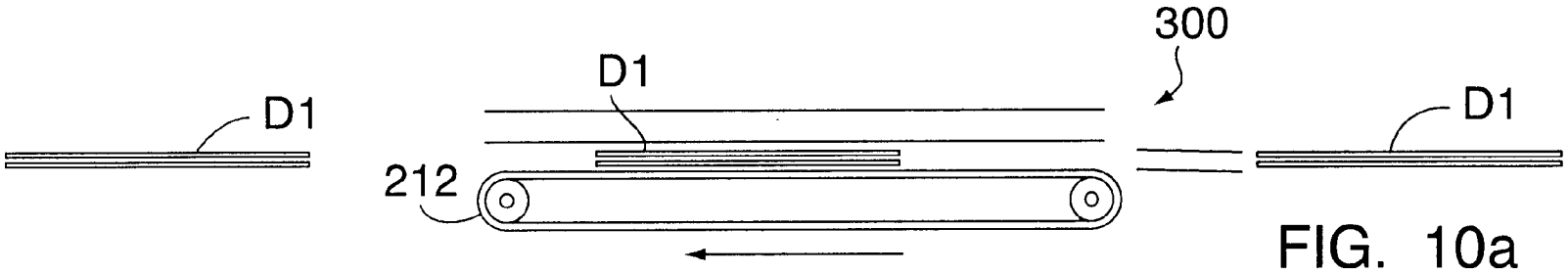
FIG. 10*a* is a schematic view illustrating, in elevation, the path and movement for the documents following a straight through path, that is without influence from the weighted rollers and associated underlying conveyor.
Figure 10C:
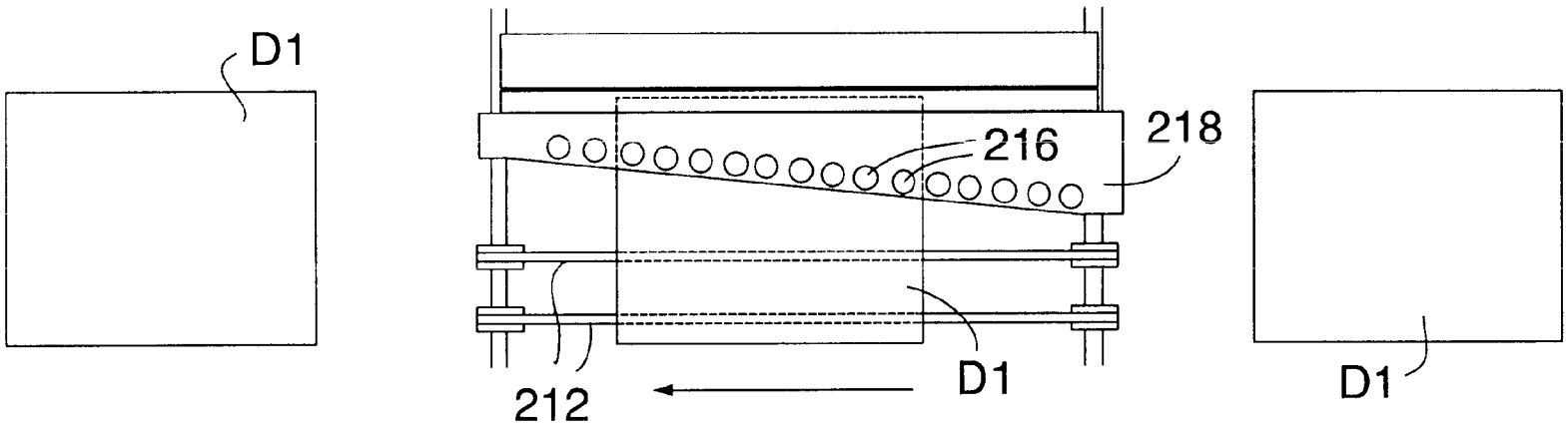
FIG. 10*c* is a schematic view illustrating, in plan, the path and movement for the documents following a straight through path, that is without influence from the weighted rollers and associated underlying conveyor.
Figure 10B:
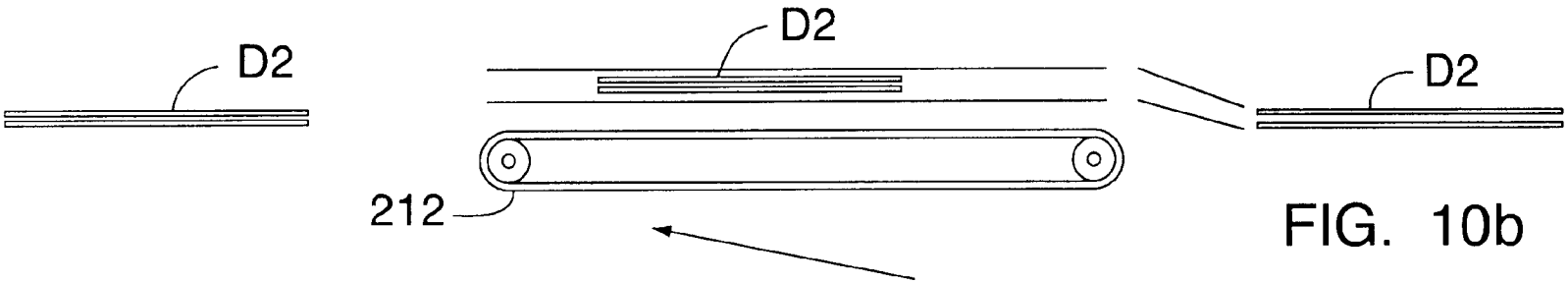
FIG. 10*b* is a view similar to FIG. 10*a*, but showing the path of the documents as they are shifted laterally to achieve the offset function of the present invention.
Figure 10D:
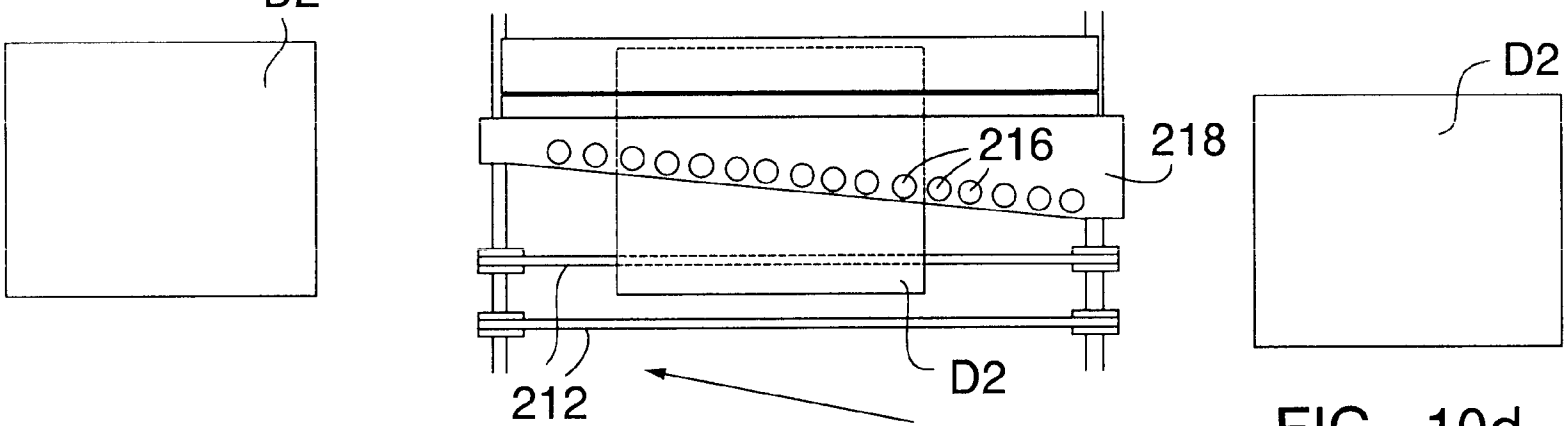
FIG. 10*d* is a view similar to FIG. 10*c*, but showing the path of the documents as they are shifted laterally to achieve the offset function of the present invention.

Referring now to the schematic views of FIGS. 10*a* and 10*b*, the first mentioned view FIG. 10*a* shows a document (D) moving straight through the apparatus by means of the conveyor belts (212) so as to reach the elevator/table and its associated stop described previously. For this purpose, a gate (300) is aligned with a first or primary path for the documents where they are not acted upon by the angled urethane belt (214) and associated roller balls (216). FIG. 10*b* shows the gate (300) deflecting the documents (D-2) upwardly for engagement by the urethane belt and associated roller ball elements for shifting the documents laterally as suggested at (D-1) in FIG. 10*b*.

Figure 11:
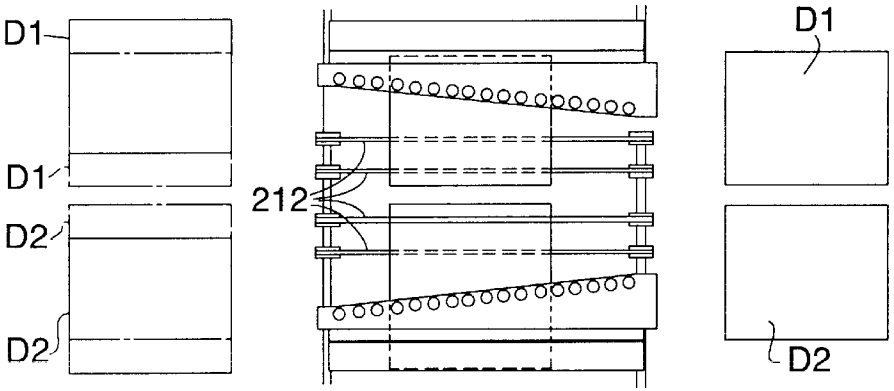
FIG. 11 is a view similar to FIGS. 10*a* and 10*b* but illustrating side-by-side streams of documents in the process of being alternatively stacked or grouped in accordance with the present invention.
Figure 12:
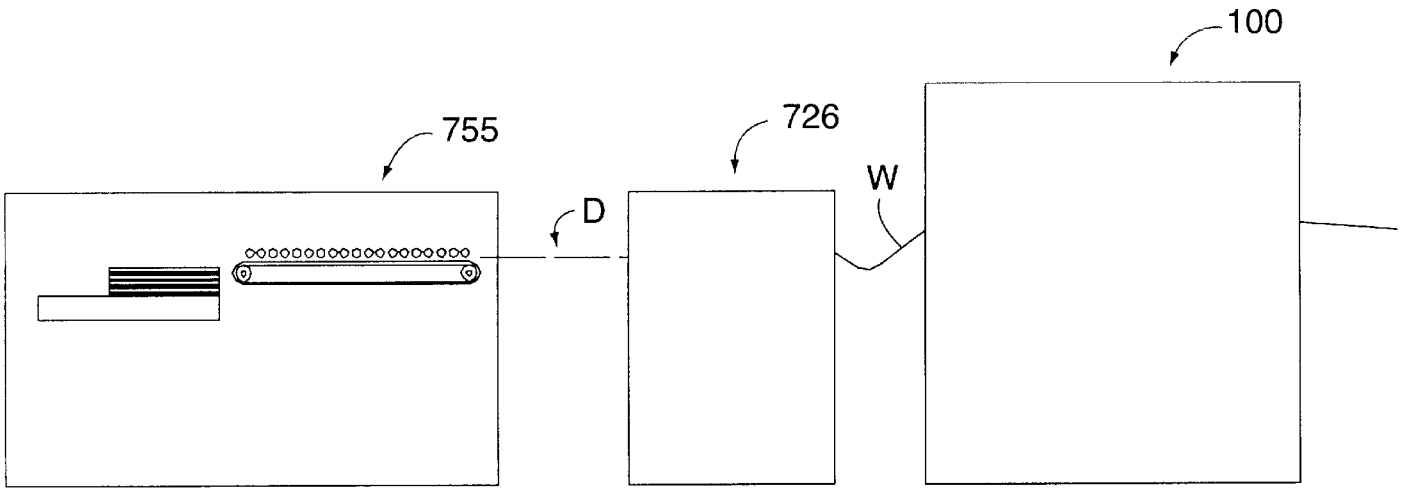
FIG. 12 is a schematic view illustrating the various stations downstream from the printer for accomplishing the documents separation in accordance with the present invention.

FIG. 11 shows two set ups similar to those in FIGS. 10*a* and 10*b* provided on alternate sides of a center line constructed through the apparatus of the present invention, to provide for handling side-by-side streams of documents with the laterally shifted groups of books (D-1/D-2) on the elevator/table as suggested schematically in FIG. 12. FIG. 12 shows the printer, the cutter, the documents (D) moving into the cabinet of the present invention and the two stations provided in the cabinet (755).

Operation

Figure 2:
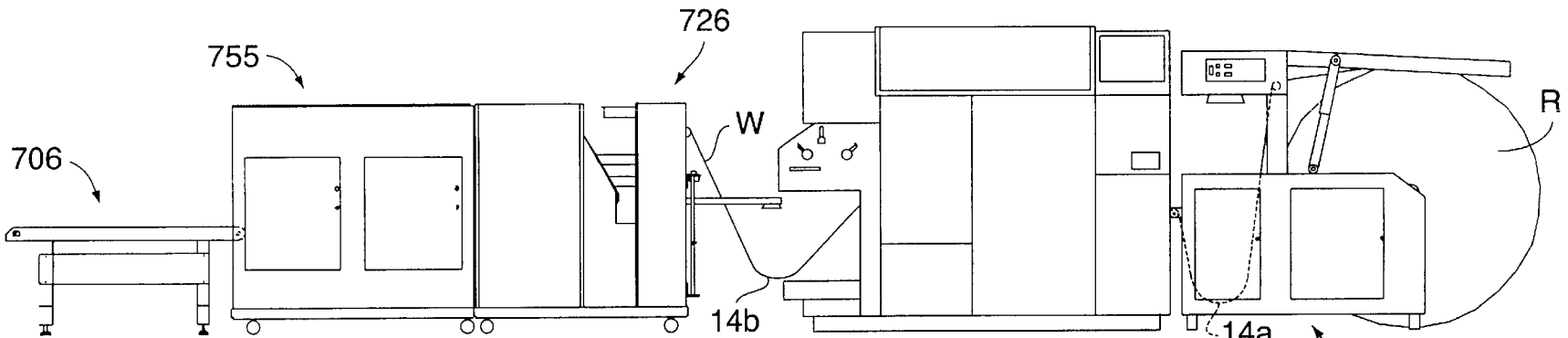
FIG. 2 is a side elevational view of the printing line depicted in FIG. 1.

FIGS. 13*a*–17 illustrate in schematic fashion the basic operation of the document separating and stacking in the equipment designated at (755) of the printing line illustrated overall in FIGS. 1 and 2. Documents are fed from right to left into the cabinet designated at (755). The documents enter the cabinet at a point designated by the arrow (250) where they ride over the retracted transfer platform defined at least in part by the reciprocating rods or pins (252) which are provided for this purpose in the upstream or first station of the cabinet (755). Belt conveyors (212) described previously carry the documents downstream in the direction of the arrow (254), the documents engage a retractable stop (256) (described previously with reference to FIG. 3).

Figure 13A:
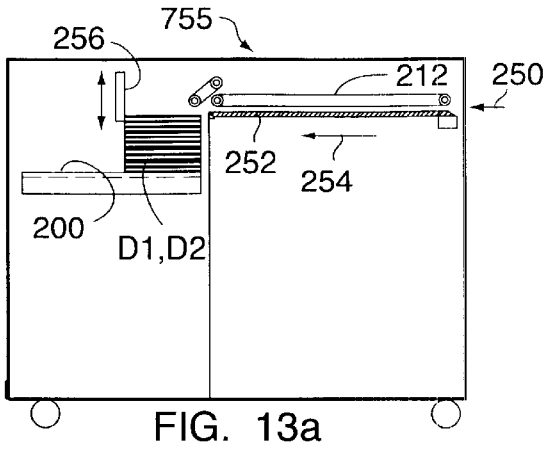
FIG. 13*a* is an elevational view of the cabinet with the upstream station and the elevator table station shown.
Figure 13B:
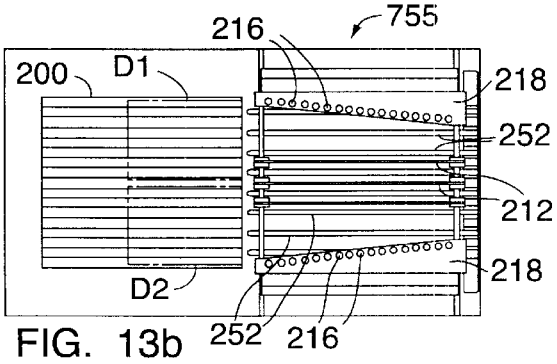
FIG. 13*b* is a plan view of FIG. 13*a*.

As shown in FIG. 13*b*, side-by-side streams of such documents (D-1 and D-2) are fed downstream in this fashion for purposes of stacking these documents on the vertically movable elevator table (200). A sensor (not shown) provides an input signal to control height of the table (200) causing the table to descend as required to receive these documents (reference FIG. 13*a* where the table (200) has descended from a raised position such as can be seen for example in FIG. 17).

Figure 5:
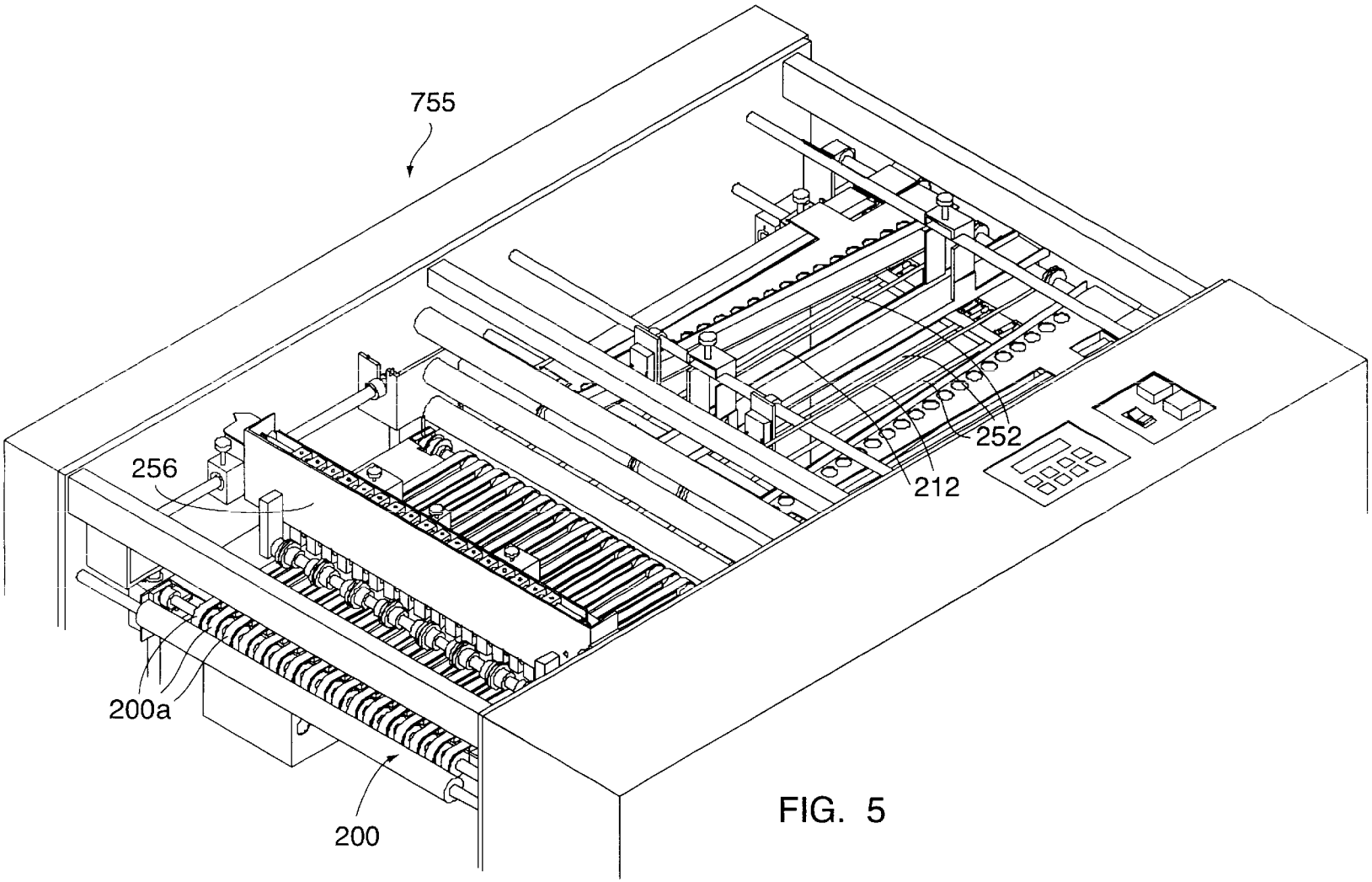
FIG. 5 is an enlarged perspective view of the cabinet of FIG. 3.

When a predetermined number of documents have been stacked in staggered relationship in accordance with the present invention on the table (200), the transfer platform defined by the pins (252) moves from right to left (compare FIG. 13*b* and FIG. 15*b*) so that these documents fed for a short time during the travel of the elevator necessary to unload the elevator will move across the stationary portion of the platform (258) onto the extended pins (252) allowing the table (200) to descend to a position where it is aligned with the takeaway conveyor (Ref. No. 706 in FIG. 3). A plurality of conveyor belts are provided on the elevator table (200) to afford the staggered document stack as best shown in FIG. 5 at (200*a*). These belts (200*a*) are intermittently operated for purposes of moving the stack of documents off the lowered table (200) onto the takeaway conveyor 706 only when the table (200) is in its lower most position as shown in FIG. 15*b*.

Figure 14A:
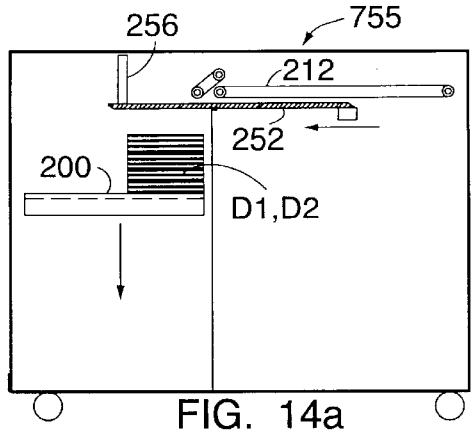
FIG. 14*a* is a view at a slightly later incident of time as compared with that of 13*a* showing the horizontal shifting movement of the pins or support surface for the documents during the descending tray operation.
Figure 14B:
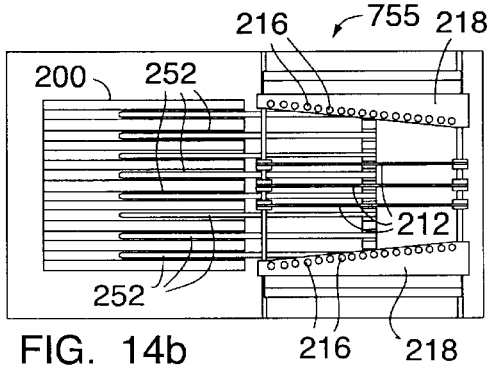
Figure 15A:
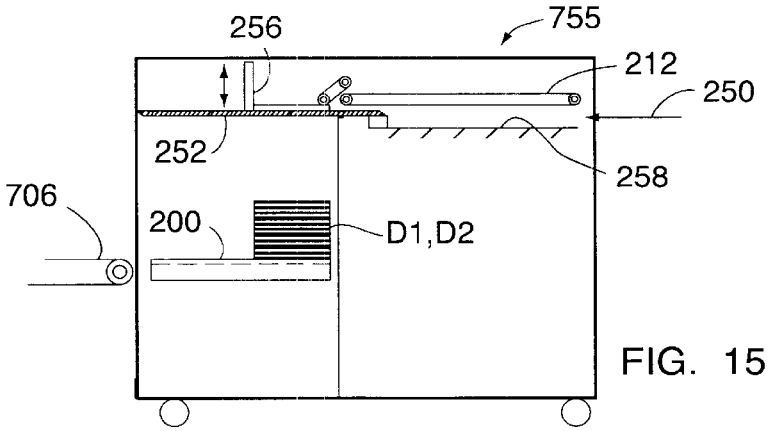
FIG. 15*a* is a view at a still later incident of time with a support surface or pins supporting documents while a pile of alternating offset stacks or groups of documents is being off loaded from the elevator/table.
Figure 15B:
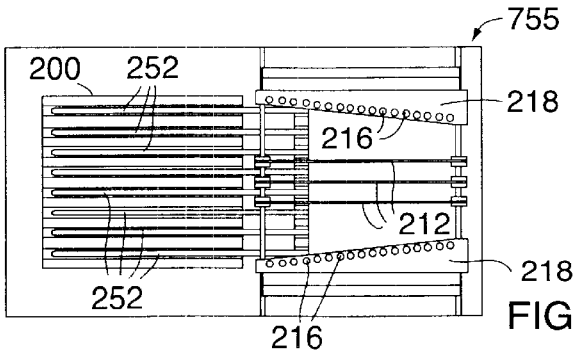
FIG. 15*b* is a plan view of 15*a*.
Figure 16:
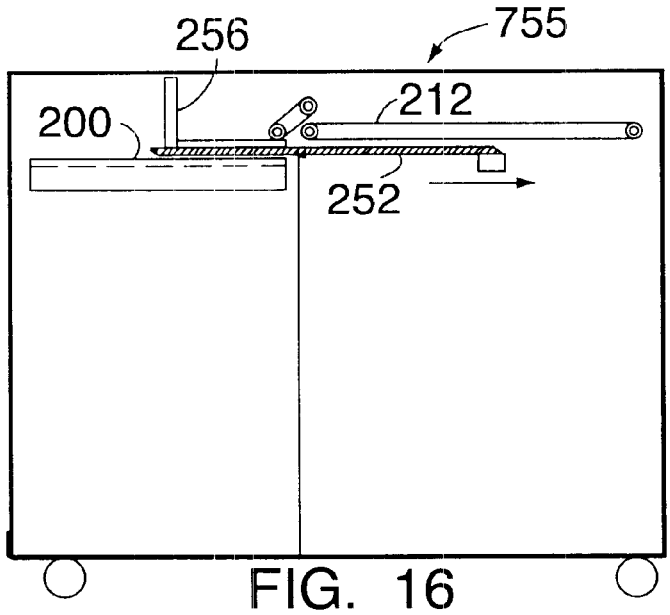
FIG. 16 shows the elevator having returned to its normal position for receiving documents, and the pins or support surface being retracted for dropping the documents onto the elevator or table in a second cycle of operation.
Figure 17:
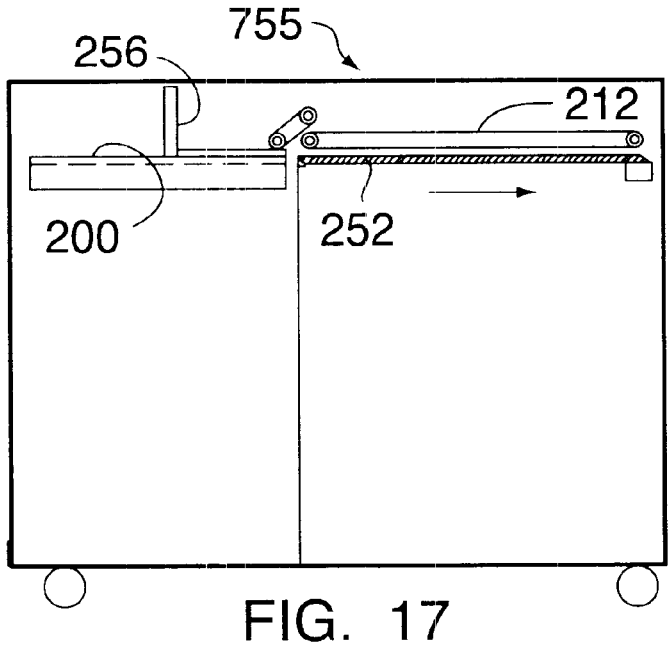
FIG. 17 shows the pins or support surface entirely retracted so as to start a new cycle of operation similar to that shown in FIG. 13*a*.

FIGS. 14*a* and 14*b* illustrate the shifting pin assembly (252) moving from the FIG. 13*a* position through the FIG. 15*b* position, and FIG. 16 shows the return motion of these pins (252). Still with reference to FIG. 16 a pivoted document feeder holds the documents in position as the pins are retracted so that they remain in a position to be received by the upwardly moving table (200) (compare FIG. 16 and FIG. 17). Once the table (200) has assumed the raised position and the pins have fully retracted as shown in FIG. 17 the documents are accumulated directly on the table (200) as shown in FIG. 13*a*. The stop (256) assures that the documents are held in aligned relationship to one another in a north/south direction, and offset laterally in the east/west direction all in accordance with the previously described mechanism for sensing the end of one book or job. Succeeding documents are redirected through the first station at the upstream end of the cabinet (755), all as described previously with reference to FIGS. 10*a* and 10*b* above.

As suggested in FIGS. 13*a*–17 the elevator or descending table/tray has grooves defined in its top surface for receiving the horizontally movable support surface rods (252). As a result of this configuration when the elevator table/tray has returned to its raised position as shown in FIGS. 16 and 17, the documents accumulated on the rods or support surface (252) will then be held in place on table (200) so that these rods (252) can be retracted as shown in FIG. 16 without need for any separate means to accomplish this transfer in control of the additional documents that will have been accumulated on the support surface pins (252).

I claim:

1. A method for grouping documents fed in a stream of end to end documents of similar size, said method comprising:

accumulating a predetermined number of documents defining a first group of documents on a vertically movable elevator, shifting a second predetermined number of documents laterally as they move downstream onto the elevator, lowering the elevator gradually to accommodate a plurality (N) of alternately staggered document groups thereon, unloading the (N) staggered document groups from the elevator, receiving additional documents on a horizontally movable support surface above the downwardly moving elevator, moving the elevator into nesting relationship with the support surface by providing the support surface in the form of spaced pins that are receivable in grooves defined in the elevator, and retracting the support surface, and repeating the above-enumerated steps.

2. The method of claim 1 further including the preliminary step of marking the last document in every group of documents, and sensing the passage of such last document in the stream of end-to-end documents, and shifting every other group of documents laterally to create the alternatively staggered document groups in response to said sensing step.

3. The method according to claim 1 further including the step of stopping the downstream movement of the documents in the odd numbered of said (N) groups at a predetermined location on the elevator or on the support surface.

4. The method of claim 3 further including the step of stopping the downstream movement of the documents in the even numbered of said (N) groups at said predetermined location on the elevator or on the support surface.

5. The method of claim 4 further including the preliminary step of marking the last document in every group of documents, and sensing the passage of such last document in the stream of end-to-end documents, and shifting every other group of documents laterally to create the alternatively staggered document groups in response to said sensing step.

6. The method of claim 5 further including the step of providing separate or alternate paths for said odd and even numbered (N) document groups.

7. The method of claim 6 further including the step of providing said separate or alternate paths one above the other, and shuttling one document group into a secondary one of said paths while allowing the other document group to move downstream on a primary path.

8. The method of claim 7 further including the step of providing a takeaway conveyor at the level of said elevator when in a down position, and transferring the staggered (N) document groups from the elevator onto the takeaway conveyor while additional documents are received on the support surface.

9. Apparatus for handling at least one stream of documents fed downstream in spaced end-to-end relationship, said apparatus comprising a first station for receiving the documents and ascertaining which document is the last document in a group of documents, a second station downstream of the first station and having an elevator for accumulating the documents thereon, said first station having a primary document path for passing documents from a first group onto said elevator where the documents reside in a first orientation, said first station having a secondary document path for laterally shifting documents from another group of documents so that the shifted groups are oriented in offset relationship to those in the first of said groups on said elevator, and document diverting means at the upstream end of said first station for selectively directing into said secondary path those documents following that document which was ascertained to be the last document in said first group; and wherein said first station defines paths for side-by-side streams of documents, and wherein each of said side-by-side streams of documents includes primary and secondary paths for shifting alternate groups laterally to provide different orientations for these document groups on said elevator.

10. The apparatus of claim 9 further including an adjustable stop above said elevator to define a downstream boundary of said first and second orientations of said alternately offset documents groups whereby said groups are offset alternately relative to one another on said elevator.

11. The apparatus according to claim 9 further including a horizontally movable document support surface, and means for moving said document support surface into said second station for supporting additional documents delivered to said first station once a predetermined number of document groups (N) are accumulated on said elevator, said first station having means for off loading said predetermined number (N) of document groups from said elevator onto a takeaway conveyor, and means for returning said elevator to a raised or uppermost position for supporting said additional documents while said support surface is so retracted.

12. The apparatus according to claim 9 further including means defining at least one angled track for engaging the marginal edge of documents traveling along said secondary path, and an angled conveyor oriented parallel said track for engaging the underside of documents traveling along said secondary path.

13. The apparatus according to claim 12 further including weighted spherical balls supported above said angled conveyor to engage the upper surface of documents traveling along said secondary path, said balls oriented on a line generally parallel to said at least one angled track.

14. The apparatus according to claim 13 further including an adjustable stop above said elevator to define a downstream boundary of said first and second orientations of said alternately offset documents groups whereby said groups are offset alternately relative to one another on said elevator.

15. The apparatus according to claim 14 further including a horizontally movable document support surface, and means for moving said document support surface into said second station for supporting additional documents delivered to said first station once a predetermined number of document groups (N) are accumulated on said elevator, said first station having means for off loading said predetermined number (N) of document groups from said elevator onto a takeaway conveyor, and means for returning said elevator to a raised or uppermost position for supporting said additional documents while said support surface is so retracted.

16. The apparatus according to claim 15 further including means defining at least one angled track for engaging the marginal edge of documents traveling along said secondary path, and an angled conveyor oriented parallel said track for engaging the underside of documents traveling along said secondary path.

17. The apparatus according to claim 15 wherein said support surface comprises a plurality of parallel pins projecting downstream and received in slots provided in said elevator to transfer said additional documents from said support surface onto said elevator when the latter is raised to receive them, and the cycle is repeated.

* * * * *